US012187569B2

(12) United States Patent
Itozaki et al.

(10) Patent No.: US 12,187,569 B2
(45) Date of Patent: Jan. 7, 2025

(54) MEDIUM TRANSPORT DEVICE AND IMAGE FORMING APPARATUS

(71) Applicant: FUJIFILM Business Innovation Corp., Tokyo (JP)

(72) Inventors: Yusuke Itozaki, Kanagawa (JP); Makio Uehara, Kanagawa (JP); Toshitaka Tanaka, Kanagawa (JP); Hiroyuki Momiyama, Kanagawa (JP); Masashi Matsumoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 203 days.

(21) Appl. No.: 17/949,658

(22) Filed: Sep. 21, 2022

(65) Prior Publication Data

US 2023/0312295 A1 Oct. 5, 2023

(30) Foreign Application Priority Data

Mar. 29, 2022 (JP) ..... 2022-052726

(51) Int. Cl.

| | |
|---|---|
| ***B65H 5/36*** | (2006.01) |
| ***B65H 29/12*** | (2006.01) |
| ***B65H 29/60*** | (2006.01) |
| ***B65H 43/00*** | (2006.01) |
| ***B65H 85/00*** | (2006.01) |

(52) U.S. Cl.

CPC ..... *B65H 5/36* (2013.01); *B65H 29/125* (2013.01); *B65H 29/60* (2013.01); *B65H 43/00* (2013.01); *B65H 85/00* (2013.01); *B65H 2301/3423* (2013.01); *B65H 2404/612* (2013.01); *B65H 2404/693* (2013.01); *B65H 2515/34* (2013.01)

(58) Field of Classification Search

CPC ... B65H 5/36; B65H 7/00; B65H 7/02; B65H 7/04; B65H 29/125; B65H 29/52; B65H 29/58; B65H 43/00; B65H 43/02; B65H 85/00; B65H 2404/612; B65H 2404/63; B65H 2404/632; B65H 2404/64; B65H 2404/693; B65H 2515/34

See application file for complete search history.

(56) References Cited

U.S. PATENT DOCUMENTS 8,109,507 B2 * 2/2012 Okumura ..... B65H 9/006 271/227
2005/0156373 A1 * 7/2005 Konagaya ..... B65H 9/06 271/226

(Continued)

FOREIGN PATENT DOCUMENTS

JP 2019-74624 A 5/2019

*Primary Examiner* — Prasad V Gokhale
(74) *Attorney, Agent, or Firm* — Oliff PLC

(57) ABSTRACT

A medium transport device includes a guide configured to guide a medium on which an image is recorded, and curved along a transport direction of the medium, and an actuator configured to actuate the guide between a contact position where the guide is in contact with the medium and a separation position where the guide is separated from the medium. The guide is configured to move to the contact position until a leading edge of the medium in the transport direction passes along the guide, and move to the separation position after the leading edge of the medium in the transport direction has passed along the guide.

17 Claims, 7 Drawing Sheets

(56) References Cited

U.S. PATENT DOCUMENTS

| | | | | |
|---|---|---|---|---|
| 2009/0324311 | A1* | 12/2009 | Matsumoto | B65H 29/52<br>271/264 |
| 2017/0158445 | A1* | 6/2017 | Urrutia Nebreda | B65H 5/062 |
| 2022/0011708 | A1* | 1/2022 | Okubo | B65H 5/38 |

* cited by examiner

MEDIUM TRANSPORT DEVICE AND IMAGE FORMING APPARATUS

CROSS-REFERENCE TO RELATED APPLICATIONS

This application is based on and claims priority under 35 USC 119 from Japanese Patent Application No. 2022-052726 filed Mar. 29, 2022.

BACKGROUND

(i) Technical Field

The present disclosure relates to a medium transport device and an image forming apparatus.

(ii) Related Art

Japanese Unexamined Patent Application Publication No. 2019-74624 ([0037]-[0061], FIGS. 2, 5, 6, 9, 10) describes the following technology in an image forming apparatus including a medium transport device that transports a medium before or after image printing.

Japanese Unexamined Patent Application Publication No. 2019-74624 describes a guide (1) that guides image-unfixed recording paper (S) between a second transfer area (Q4) and a fixing area (Q5). Even if the recording paper (S) is slacked due to a difference in its transport speed between the second transfer area (Q4) and the fixing area (Q5), the guide (1) moves away from the recording paper (S) to reduce adverse effects on the transport of the recording paper (S), thereby suppressing transfer failure or paper creasing in the fixing area. In Japanese Unexamined Patent Application Publication No. 2019-74624, the guide (1) is supported by a coil spring (4) in a movable manner, or is moved by a solenoid (31).

SUMMARY

Aspects of non-limiting embodiments of the present disclosure relate to suppression of damage to an image recorded on a medium compared with a case where a medium guide that has guided the leading edge of the medium comes into contact with a portion of the medium that follows the leading edge.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium transport device comprising: a guide configured to guide a medium on which an image is recorded, and curved along a transport direction of the medium; and an actuator configured to actuate the guide between a contact position where the guide is in contact with the medium and a separation position where the guide is separated from the medium, wherein the guide is configured to move to the contact position until a leading edge of the medium in the transport direction passes along the guide, and move to the separation position after the leading edge of the medium in the transport direction has passed along the guide.

BRIEF DESCRIPTION OF THE DRAWINGS

Exemplary embodiments of the present disclosure will be described in detail based on the following figures, wherein.

DETAILED DESCRIPTION

Figure 1:
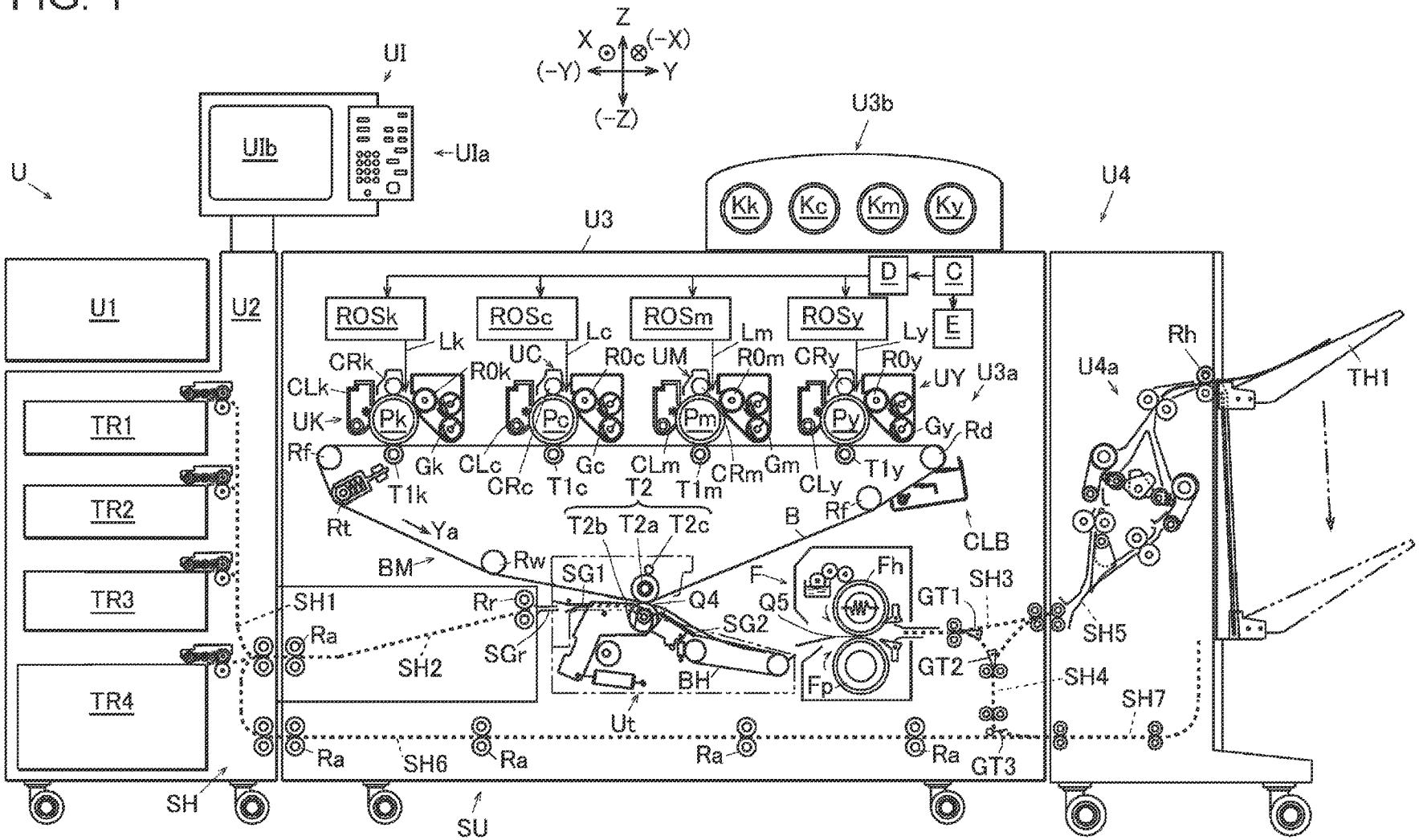
FIG. 1 illustrates an overall image forming apparatus of a first exemplary embodiment.

Exemplary embodiments of the present disclosure are described with reference to the drawings. The exemplary embodiment of the present disclosure is not limited to the following exemplary embodiments.

To facilitate understanding of the following description, the drawings illustrate a fore-and-aft direction as an X-axis direction, a lateral direction as a Y-axis direction, and a vertical direction as a Z-axis direction. In the drawings, directions or sides indicated by arrows X, −X, Y, −Y, Z, and −Z are defined as "forward", "rearward", "rightward", "leftward", "upward", and "downward", or "front side", "rear side", "right side", "left side", "upper side", and "lower side", respectively.

In the drawings, a symbol represented by a dot in a circle means an arrow from back to front on the drawing sheet, and a symbol represented by a letter "x" in a circle means an arrow from front to back on the drawing sheet.

In the following description with reference to the drawings, illustrations other than members necessary to facilitate understanding are omitted as appropriate.

First Exemplary Embodiment

FIG. 1 illustrates an overall image forming apparatus of a first exemplary embodiment.

Figure 2:
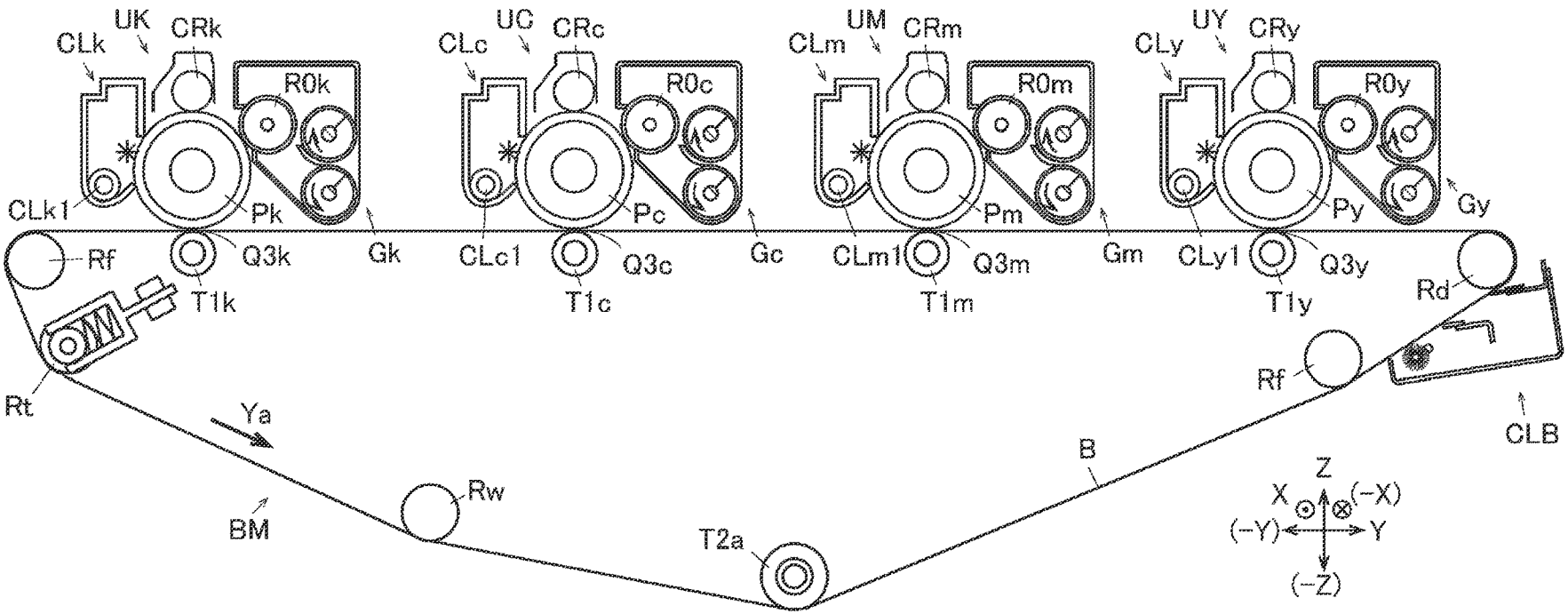
FIG. 2 is an enlarged view of a visible image forming device of the first exemplary embodiment.

FIG. 2 is an enlarged view of a visible image forming device of the first exemplary embodiment.

In FIG. 1, a copying machine U that is an example of an image forming apparatus includes a user interface UI that is an example of an operator, a scanner U1 that is an example of an image reading device, a feeder U2 that is an example of a medium feeding device, an image forming unit U3 that is an example of an image recording device, and a medium processing device U4.

(User Interface UI)

The user interface UI includes input buttons UIa to be used for starting copying and setting the number of copies. The user interface UI further includes a display UIb that displays information input by using the input buttons UIa and the status of the copying machine U.

(Feeder U2)

In FIG. 1, the feeder U2 includes a plurality of paper feed trays TR1, TR2, TR3, and TR4 that are examples of a medium container. The feeder U2 further includes a medium feed path SH1 along which recording paper S that is an example of an image recording medium is picked out from any one of the paper feed trays TR1 to TR4 and transported to the image forming unit U3.

(Image Forming Unit U3 and Medium Processing Device U4)

In FIG. 1, the image forming unit U3 includes an image recorder U3*a* that records an image on the recording paper S transported from the feeder U2 based on a document image read by the scanner U1.

In FIG. 1 and FIG. 2, a latent image forming device driving circuit D of the image forming unit U3 outputs, based on image information input from the scanner U1, driving signals to yellow (Y), magenta (M), cyan (C), and black (K) latent image forming devices ROSy, ROSm, ROSc, and ROSk at preset timings. Photoconductor drums Py, Pm, Pc, and Pk that are examples of an image carrier are disposed below the latent image forming devices ROSy to ROSk that are examples of a writer, respectively.

The surfaces of the rotating photoconductor drums Py to Pk are uniformly charged by charging rollers CRy, CRm, CRc, and CRk that are examples of a charger, respectively. Electrostatic latent images are formed on the charged surfaces of the photoconductor drums Py to Pk by laser beams Ly, Lm, Lc, and Lk that are examples of latent image writing light and output from the latent image forming devices ROSy to ROSk, respectively. The electrostatic latent images are developed into yellow (Y), magenta (M), cyan (C), and black (K) toner images that are examples of a visible image by developing devices Gy, Gm, Gc, and Gk that are examples of a developing unit, respectively.

In the developing devices Gy to Gk, developers consumed by development are supplied from toner cartridges Ky, Km, Kc, and Kk that are examples of a developer container, respectively. The toner cartridges Ky to Kk are removably mounted on a developer supply device U3*b*.

The toner images on the surfaces of the photoconductor drums Py to Pk are sequentially transferred and laid over one another in first transfer areas Q3*y*, Q3*m*, Q3*c*, and Q3*k* on an intermediate transfer belt B that is an example of an intermediate transferer by first transfer rollers T1*y*, T1*m*, T1*c*, and T1*k* that are examples of a first transferer, respectively. Thus, a color toner image that is an example of a multicolor visible image is formed on the intermediate transfer belt B. The color toner image is transported to a second transfer area Q4.

In a case of black image information alone, the black photoconductor drum Pk and the black developing device Gk are used to form a black toner image.

On the photoconductor drums Py to Pk after the first transfer, drum cleaners CLy, CLm, CLc, and CLk that are examples of an image carrier cleaner remove residues such as residual developers or paper dust on the surfaces, respectively.

In the first exemplary embodiment, the photoconductor drum Pk, the charging roller CRk, and the drum cleaner CLk are integrated into a black photoconductor unit UK that is an example of an image carrier unit. In the other colors (yellow, magenta, and cyan) as well, the photoconductor drums Py, Pm, and Pc, the charging rollers CRy, CRm, and CRc, and the drum cleaners CLy, CLm, and CLc constitute photoconductor units UY, UM, and UC, respectively.

The black photoconductor unit UK and the developing device Gk including a developing roller ROk that is an example of a developer carrier constitute a black image former UK+Gk. Similarly, the yellow, magenta, and cyan photoconductor units UY, UM, and UC and the developing devices Gy, Gm, and Gc including developing rollers ROy, ROm, and ROc constitute yellow, magenta, and cyan image formers UY+Gy, UM+Gm, and UC+Gc, respectively.

A belt module BM that is an example of the intermediate transferer is disposed below the photoconductor drums Py to Pk. The belt module BM includes the intermediate transfer belt B that is an example of the image carrier, a driving roller Rd that is an example of an intermediate transferer driver, a tension roller Rt that is an example of a tensile force applier, a walking roller Rw that is an example of a meandering preventer, a plurality of idler rollers Rf that are examples of a driven component, a backup roller T2*a* that is an example of a facing component, and the first transfer rollers T1*y* to T1*k*. The intermediate transfer belt B is supported while being rotatable in an arrow Ya direction.

In the first exemplary embodiment, the yellow, magenta, and cyan first transfer rollers T1*y*, T1*m*, and T1*c* are supported while being approachable to or separable from the photoconductor drums Py, Pm, and Pc, respectively. In multicolor printing, the yellow, magenta, and cyan first transfer rollers T1*y*, T1*m*, and T1*c* approach the photoconductor drums Py to Pc, respectively, to nip the intermediate transfer belt B at a predetermined contact pressure. In monochrome printing using black alone, the first transfer rollers T1*y*, T1*m*, and T1*c* are separated from the photoconductor drums Py to Pc, respectively.

A second transfer unit Ut is disposed below the backup roller T2*a*. The second transfer unit Ut includes a second transfer roller T2*b* that is an example of a second transferer. The second transfer area Q4 is an area where the second transfer roller T2*b* is in contact with the intermediate transfer belt B. The backup roller T2*a* faces the second transfer roller T2*b* across the intermediate transfer belt B. A contact roller T2*c* that is an example of a power supplier is in contact with the backup roller T2*a*. A second transfer voltage having the same polarity as a toner charging polarity is applied to the contact roller T2*c*.

The backup roller T2*a*, the second transfer roller T2*b*, and the contact roller T2*c* constitute a second transferer T2.

The second transfer unit Ut of the first exemplary embodiment is approachable to or separable from the intermediate transfer belt B. Depending on the type of the recording paper S in use, the second transfer unit Ut moves to change the contact pressure between the second transfer roller T2*b* and the intermediate transfer belt B. For example, in a case of thick paper, the contact pressure is reduced compared with a case of plain paper to reduce an impact when the leading edge of the thick paper enters the second transfer area Q4.

A medium transport path SH2 is disposed below the belt module BM. The recording paper S fed through the medium feed path SH1 of the feeder U2 is transported to registration rollers Rr that are an example of a transport timing adjuster by transport rollers Ra that are an example of a medium transporter. The registration rollers Rr transport the recording paper S downstream in synchronization with a timing when the toner image formed on the intermediate transfer belt B is transported to the second transfer area Q4. The recording paper S sent out by the registration rollers Rr is guided by a registration paper guide SGr and a pre-transfer paper guide SG1 and transported to the second transfer area Q4.

The toner image on the intermediate transfer belt B is transferred onto the recording paper S by the second transferer T2 when passing through the second transfer area Q4. In the case of a color toner image, the toner images firstly transferred onto the surface of the intermediate transfer belt B and laid over one another are secondly transferred collectively onto the recording paper S.

The first transfer rollers T1*y* to T1*k*, the second transferer T2, and the intermediate transfer belt B constitute a transfer device (transferer) T1*y*-T1*k*+T2+B of the first exemplary embodiment.

The intermediate transfer belt B after the second transfer is cleaned by a belt cleaner CLB that is an example of an intermediate transferer cleaner disposed on a downstream side of the second transfer area Q4. The belt cleaner CLB removes, from the intermediate transfer belt B, residues such as paper dust or developers that remain without being transferred in the second transfer area Q4.

The recording paper S onto which the toner image is transferred is guided by a post-transfer paper guide SG2 and sent to a belt transport device BH that is an example of the medium transporter. The belt transport device BH transports the recording paper S to a fixing device F.

The fixing device F includes a heating roller Fh that is an example of a heater, and a pressure roller Fp that is an example of a pressurizer. The recording paper S is transported to a fixing area Q5 where the heating roller Fh is in contact with the pressure roller Fp. The toner image on the recording paper S is fixed by being heated and pressurized by the fixing device F when passing through the fixing area Q5.

The image formers UY+Gy to UK+Gk, the transfer device T1*y*–T1*k*+T2+B, and the fixing device F constitute the image recorder U3*a* that is an example of an image former of the first exemplary embodiment.

A first gate GT1 that is an example of a switcher is provided on a downstream side of the fixing device F. The first gate GT1 selectively switches the recording paper S having passed through the fixing area Q5 into an output path SH3 toward the medium processing device U4 or into a reversing path SH4. The recording paper S transported to the output path SH3 is transported to a paper transport path SH5 of the medium processing device U4. A curl correction member U4*a* that is an example of a warp corrector is disposed on the paper transport path SH5. The curl correction member U4*a* corrects a warp, that is, a curl of the transported recording paper S. The recording paper S having undergone the curl correction is output, with its image-fixed side oriented upward, to an output tray TH1 that is an example of a medium outputter by output rollers Rh that are an example of a medium output member.

The recording paper S transported toward the reversing path SH4 of the image forming unit U3 by the first gate GT1 is transported to the reversing path SH4 through a second gate GT2 that is an example of a switching member.

To output the recording paper S with its image-fixed side oriented downward, the transport direction of the recording paper S is reversed after the trailing edge of the recording paper S in the transport direction has passed through the second gate GT2. When the recording paper S having passed through the second gate GT2 is reversed, that is, switched back, the recording paper S is guided toward the transport paths SH3 and SH5. The switched-back recording paper S is output to the output tray TH1 through the curl correction member U4*a* with its image-fixed side oriented downward.

A circulation path SH6 is connected to the reversing path SH4 of the image forming unit U3. A third gate GT3 that is an example of the switcher is disposed at the connecting portion. The downstream end of the reversing path SH4 is connected to a reversing path SH7 of the medium processing device U4.

The recording paper S transported to the reversing path SH4 through the first gate GT1 is transported toward the reversing path SH7 of the medium processing device U4 by the third gate GT3. The third gate GT3 of the first exemplary embodiment is a thin-film elastic member. The third gate GT3 causes the recording paper S to temporarily pass when it is transported along the reversing path SH4, and guides the recording paper S toward the circulation path SH6 when the recording paper S is switched back.

The recording paper S transported to the circulation path SH6 is sent again to the second transfer area Q4 through the medium transport path SH2, and printing is performed on the second side.

The elements SH1 to SH7 constitute a paper transport path SH. The elements SH, Ra, Rr, Rh, SGr, SG1, SG2, BH, and GT1 to GT3 constitute a paper transport device SU of the first exemplary embodiment.

(Medium Transport Device)

Figure 3:
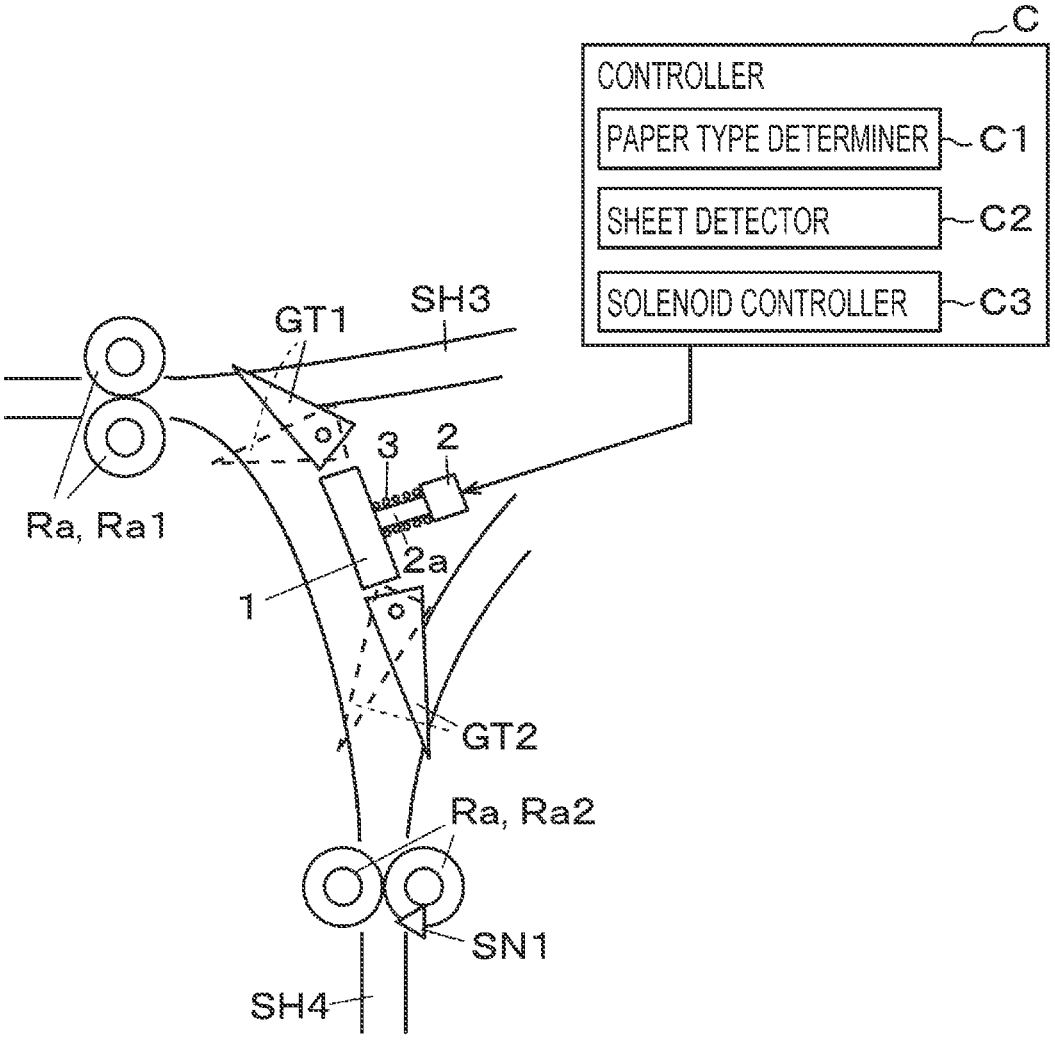
FIG. 3 illustrates a medium transport device of the first exemplary embodiment.

FIG. 3 illustrates a medium transport device of the first exemplary embodiment.

Figure 4:
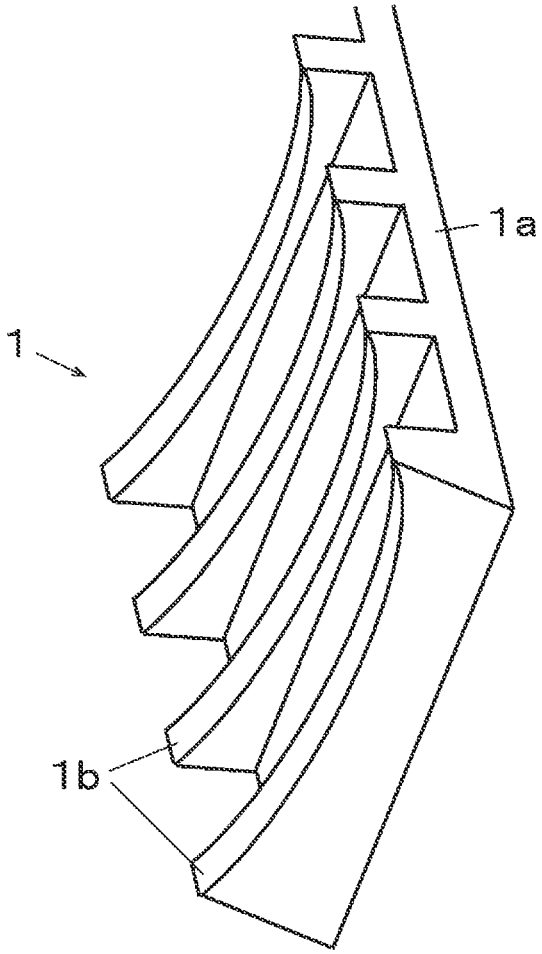
FIG. 4 is an enlarged view of a guide of the first exemplary embodiment.

FIG. 4 is an enlarged view of a guide of the first exemplary embodiment.

In FIG. 3, the paper transport device SU of the first exemplary embodiment that is an example of the medium transport device includes a sheet guide 1 that is an example of the guide. The sheet guide 1 is disposed at a curved portion of the reversing path SH4 between the first gate GT1 and the second gate GT2.

In FIG. 4, the sheet guide 1 has a base 1*a* having a width corresponding to the width of the recording paper S, and projecting threads 1*b* projecting toward the recording paper S from the base 1*a*. The surface of the projecting thread 1*b* along the transport direction of the recording paper S has an arc shape. A plurality of projecting threads 1*b* are disposed with distances therebetween in a width direction of the recording paper S.

Figure 5A:
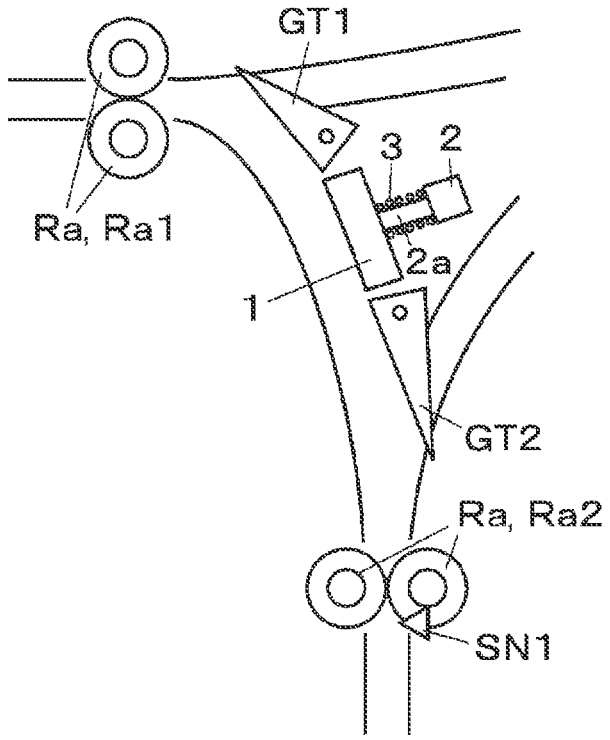
FIG. 5A illustrates the guide of the first exemplary embodiment moved to a contact position.
Figure 5B:
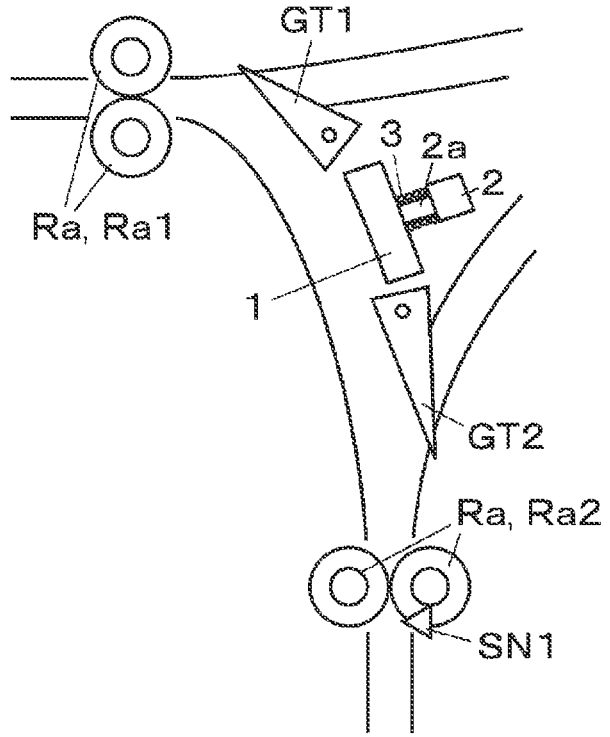
FIG. 5B illustrates the guide of the first exemplary embodiment moved to a separation position.

FIG. 5A illustrates the guide of the first exemplary embodiment moved to a contact position. FIG. 5B illustrates the guide of the first exemplary embodiment moved to a separation position.

In FIG. 3, the base 1*a* of the sheet guide 1 is supported on the tip of a plunger 2*a* of a solenoid 2 that is an example of an actuator. A coil spring 3 that is an example of an urging member is attached to the plunger 2*a*.

While the solenoid 2 is not operating, the plunger 2*a* is stretched by an elastic force of the coil spring 3. As illustrated in FIG. 5A, the sheet guide 1 moves inward in the reversing path SH4 to the contact position where the sheet guide 1 is in contact with the recording paper S. While the solenoid 2 is operating, the plunger 2*a* is contracted by an electromagnetic force. As illustrated in FIG. 5B, the sheet guide 1 is retracted from the reversing path SH4 to the separation position where the sheet guide 1 is separated from the recording paper S. Therefore, the sheet guide 1 of the first exemplary embodiment moves, that is, slides along a thickness direction of the transported recording paper S along with the operation of the solenoid 2.

A sheet sensor SN1 that is an example of a medium detector is disposed near transport rollers Ra on a downstream side of the second gate GT2. The sheet sensor SN1 detects the recording paper S. The passage of the leading edge and the trailing edge of the recording paper S and a paper jam may be detected based on a result of detection as to whether the recording paper S is present.

(Controller of First Exemplary Embodiment)

In FIG. 3, a controller C of the copying machine U includes an input/output interface I/O for inputting signals from and outputting signals to the outside. The controller C includes a read-only memory (ROM) that stores programs and information for processes. The controller C further includes a random-access memory (RAM) that temporarily stores data. The controller C further includes a central processing unit (CPU) that performs processes based on the programs stored in the ROM or the like. The controller C of the first exemplary embodiment is a small-size information processing device, that is, a microcomputer. The controller C may implement various functions by executing the programs stored in the ROM or the like.

The controller C of the first exemplary embodiment receives signals from signal output elements such as the sheet sensor SN1, and controls control target elements such as the solenoid 2 and the gates GT1 to GT3 by outputting signals thereto.

(Functions of Controller C)

The controller C of the first exemplary embodiment includes the following functional elements (functional modules or program modules) C1 to C3.

A paper type determiner C1 that is an example of a medium type determiner determines the type of the recording paper S in use. Examples of the medium type to be determined in the first exemplary embodiment include "plain paper", "thin paper", and "thick paper". The medium type determination may be made not only by the exemplified method but also based on a basis weight or flexural rigidity (paper stiffness) of paper.

A sheet detector C2 that is an example of a medium position detector determines, based on a detection result from the sheet sensor SN1, whether the leading edge of the recording paper S has passed by the sheet sensor SN1, that is, whether the leading edge of the recording paper S has already passed along the sheet guide 1.

A solenoid controller C3 that is an example of an actuation controller controls the solenoid 2. In a case of duplex printing, the solenoid controller C3 of the first exemplary embodiment controls the solenoid 2 not to operate so that the sheet guide 1 is kept at the contact position until the recording paper S having an image printed on the first side is transported to the reversing path SH4. When the leading edge of the recording paper S in the transport direction has passed along the sheet guide 1, the solenoid controller C3 controls the solenoid 2 to operate so that the sheet guide 1 is moved to the separation position. In the first exemplary embodiment, determination is made that the leading edge of the recording paper S in the transport direction has passed along the sheet guide 1 in response to detection of the recording paper S by the sheet sensor SN1. The solenoid controller C3 of the first exemplary embodiment controls the sheet guide 1 to move to the separation position if the paper type is thick paper, and keeps the sheet guide 1 at the contact position instead of the separation position if the paper type is plain paper or thin paper.

Operations of First Exemplary Embodiment

During the duplex printing in the copying machine U of the first exemplary embodiment having the structure described above, the recording paper S having an image fixed to the first side is transported to the reversing path SH4 and sent to the circulation path SH6. The recording paper S transported along the circulation path SH6 is sent to the second transfer area Q4 with its sides reversed, and an image is transferred onto the second side.

Figure 6A:
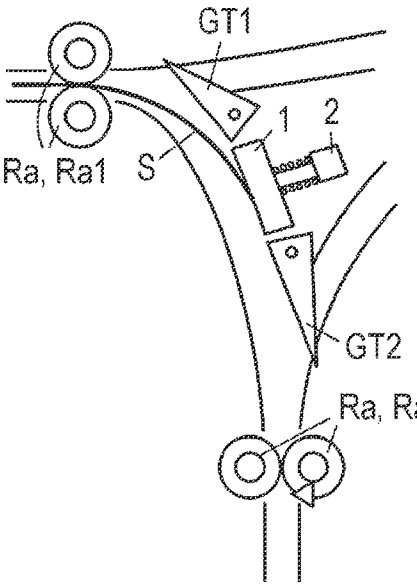
FIG. 6A illustrates an operation of the first exemplary embodiment when the leading edge of recording paper has approached a sheet guide.
Figure 6B:
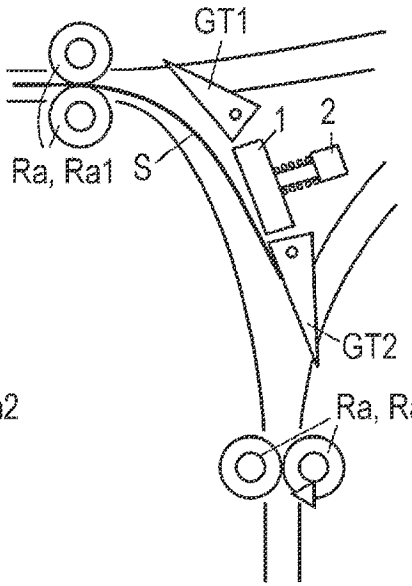
FIG. 6B illustrates an operation of the first exemplary embodiment when the recording paper in FIG. 6A is transported downstream.
Figure 6C:
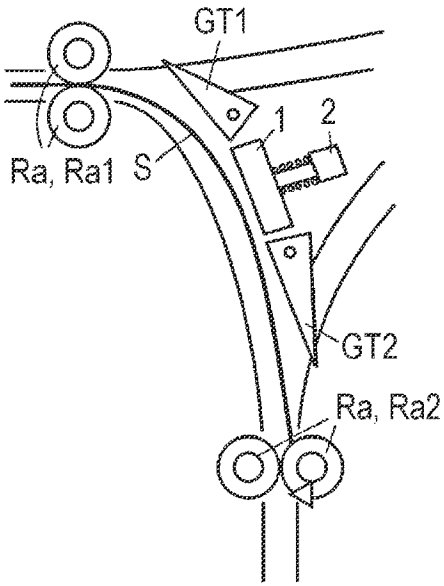
FIG. 6C illustrates an operation of the first exemplary embodiment when the recording paper in FIG. 6B is transported downstream.
Figure 6D:
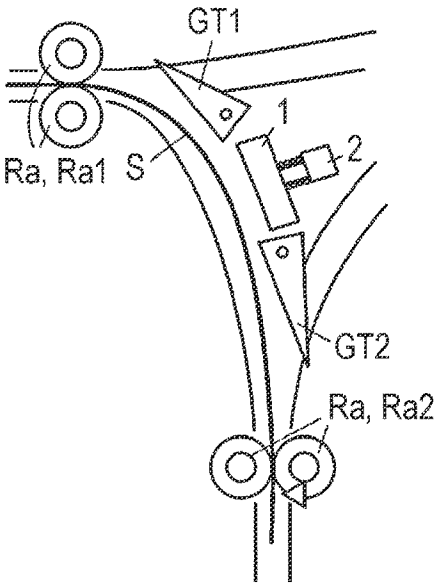
FIG. 6D illustrates an operation of the first exemplary embodiment when the recording paper in FIG. 6C is transported downstream.

FIG. 6A illustrates an operation of the first exemplary embodiment when the leading edge of recording paper has approached the sheet guide. FIG. 6B illustrates an operation of the first exemplary embodiment when the recording paper in FIG. 6A is transported downstream. FIG. 6C illustrates an operation of the first exemplary embodiment when the recording paper in FIG. 6B is transported downstream. FIG. 6D illustrates an operation of the first exemplary embodiment when the recording paper in FIG. 6C is transported downstream.

In FIG. 6A, the recording paper S having an image fixed to the first side is sent to the reversing path SH4. The leading edge of the recording paper S in the transport direction is guided by coming into contact with the sheet guide 1 at the contact position. The sheet guide 1 is moved to the separation position when the leading edge has reached the transport rollers Ra on the downstream side.

In the related art in which the sheet guide in contact with the recording paper S after fixing is immovable, a problem arises in that the surface of the recording paper S is abraded and the image is damaged to reduce the value of the printed product. The sheet guide 1 of the first exemplary embodiment that has guided the leading edge of the recording paper S is moved to the separation position and hardly comes into contact with a portion of the recording paper S that follows the leading edge.

The sheet guide 1 of the first exemplary embodiment is disposed at the curved portion of the reversing path SH4. Therefore, the recording paper S is transported in a curved shape, and the posture of the recording paper S may become unstable (bulging posture) compared with a case where the recording paper S is transported in a flat posture. In particular, in the structure of the first exemplary embodiment, transport rollers Ra1 disposed on an upstream side of the first gate GT1 and used during every printing and transport rollers Ra2 disposed on a downstream side of the second gate GT2 and not used during simplex printing may be worn differently over time, thereby causing a difference in the transport speed between the transport rollers Ra1 and Ra2. Therefore, the recording paper S may slack between the rollers Ra1 and Ra2 and bulge in the curved reversing path SH4. Although the sheet guide 1 immovable to the separation position is likely to come into contact with the recording paper S, the sheet guide 1 of the first exemplary embodiment movable to the separation position is unlikely to come into contact with the recording paper S.

In particular, the sheet guide 1 of the first exemplary embodiment is disposed on an outer side of the curved portion of the reversing path SH4 to face the surface of the recording paper S immediately after an image has been fixed. At the position immediately after the fixing, there is a possibility that the molten toner is not sufficiently cooled (solidified). The image may be damaged if the sheet guide 1 comes into contact with the image surface. In the first exemplary embodiment, the sheet guide 1 facing the image surface is moved to the separation position.

The sheet guide 1 of the first exemplary embodiment slides in the thickness direction of the recording paper S along with the operation of the solenoid 2. If the moving distance of the sheet guide 1 differs between the upstream side and the downstream side in the transport direction of the recording paper S, the sheet guide 1 may come into contact with the recording paper S on the upstream or downstream side. In the first exemplary embodiment, the sheet guide 1 is separated from the recording paper S by sliding.

In the first exemplary embodiment, the sheet guide 1 is moved based on the detection result from the sheet sensor SN1. Although the sheet guide 1 may be moved in response to detection of actual contact between the sheet guide 1 and the recording paper S, the abrasion at the time of contact detection is not prevented.

In the first exemplary embodiment, the sheet guide 1 is moved to the separation position if the paper type is thick paper, and is not moved to the separation position if the paper type is plain paper. The thick paper is not easily curved due to its high flexural rigidity. Therefore, the contact pressure at the time of contact between the thick paper and the sheet guide 1 is likely to increase to cause damage compared with a case where the contact pressure is low. The plain paper or thin paper is curved more easily than the thick paper. Therefore, the contact pressure is low and damage is unlikely to occur.

The sheet guide 1 of the first exemplary embodiment has the projecting threads 1*b*. If the contact area decreases, the contact pressure increases and streaking abrasion and damage to the image are likely to occur at the part where the sheet guide 1 comes into contact with the recording paper S. In the sheet guide 1 of the first exemplary embodiment, the projecting threads 1*b* come into contact with the recording paper S with a small transport resistance while the leading edge of the recording paper S is being guided, and are moved to the separation position when the leading edge of the recording paper S has passed.

Second Exemplary Embodiment

A second exemplary embodiment of the present disclosure is described next. In the description of the second exemplary embodiment, components corresponding to those in the first exemplary embodiment are represented by the same reference symbols and detailed description is omitted.

The second exemplary embodiment differs from the first exemplary embodiment in the following points, but is similar to the first exemplary embodiment in the other points.

Figure 7:
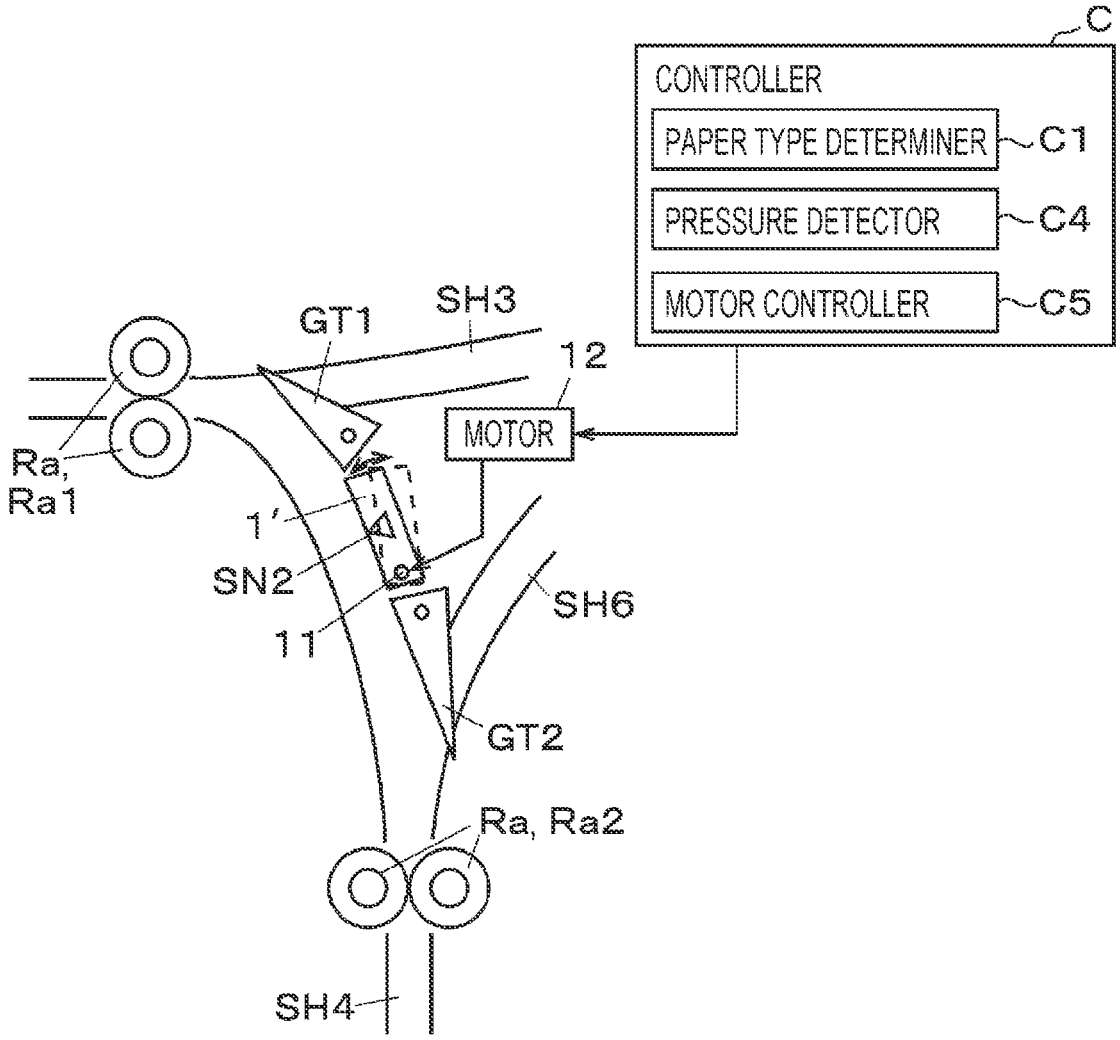
FIG. 7 illustrates a sheet guide of a second exemplary embodiment viewed from the same angle as in FIG. 3 of the first exemplary embodiment.

FIG. 7 illustrates a sheet guide of the second exemplary embodiment viewed from the same angle as in FIG. 3 of the first exemplary embodiment.

In FIG. 7, a sheet guide 1' of the second exemplary embodiment is not supported on the solenoid 2 but is supported while being rotatable about a rotation shaft 11 unlike the sheet guide 1 of the first exemplary embodiment. The sheet guide 1' of the second exemplary embodiment is movable between a contact position indicated by a solid line in FIG. 7 and a separation position indicated by a broken line. Rotation is transmissible to the rotation shaft 11 from a motor 12 that is an example of the actuator.

In the second exemplary embodiment, a load cell SN2 that is an example of a pressure detection member is disposed in place of the sheet sensor SN1. The load cell SN2 detects a contact pressure in response to contact with the recording paper S, and a known related-art member may be used.

The controller C of the second exemplary embodiment includes the following functional elements (functional modules or program modules) C4 and C5 in place of the elements C2 and C3 of the first exemplary embodiment.

A pressure detector C4 detects a pressure of the recording paper S in contact with the sheet guide 1' based on a detection result from the load cell SN2.

A motor controller C5 that is an example of the actuation controller controls the motor 12. In the case of duplex printing, the motor controller C5 of the second exemplary embodiment controls the motor 12 to move the sheet guide 1' to the contact position until the recording paper S having an image printed on the first side is transported to the reversing path SH4. When the leading edge of the recording paper S in the transport direction has passed along the sheet guide 1' and then the pressure detected by the load cell SN2 has reached a predetermined pressure (threshold), the motor controller C5 controls the motor 12 to move the sheet guide 1' to the separation position. The motor controller C5 of the second exemplary embodiment controls the sheet guide 1' to move to the separation position if the paper type is thick paper or thin paper, and keeps the sheet guide 1' at the contact position instead of the separation position if the paper type is plain paper.

The threshold may be, but is not limited to, 0.02 $N/mm^2$ at which the possibility of abrasion increases. The threshold may be changed as appropriate depending on, for example, the curvature of the curved portion of the reversing path SH4, angles at the start point and the end point of the curve in the transport direction, or the flexural rigidity of the recording paper S. The threshold may be varied between the thick paper and the thin paper, and may be changed depending on the paper type.

Operations of Second Exemplary Embodiment

In the copying machine U of the second exemplary embodiment having the structure described above, the sheet guide 1' is moved to the separation position when the leading edge of the recording paper S comes into contact with the sheet guide 1' and then the load cell SN2 detects a contact pressure higher than the threshold.

In the second exemplary embodiment, the sheet guide 1' is moved to the separation position in the case of thin paper as well as thick paper that is not easily curved so that the contact pressure is likely to increase. The thin paper is likely to buckle due to its low flexural rigidity. Therefore, the thin paper buckles at a high contact pressure to cause damage such as paper creasing or cause a paper jam.

(Modifications)

Modifications (H01) to (H06) of the exemplary embodiments of the present disclosure are described below.

(H01) In the exemplary embodiments, the copying machine U is provided as the example of the image forming apparatus. The image forming apparatus may be a FAX machine or a multifunction peripheral having a plurality of functions of a FAX machine, a printer, and a copying machine. The image forming apparatus is not limited to the multicolor-development image forming apparatus, and may be a monochrome image forming apparatus. Further, any electronic or mechanical apparatus using motors and gears may be an alternative to the image forming apparatus.

(H02) In the exemplary embodiments, the sheet guide 1, 1' is disposed in the reversing path SH4, but may be disposed at any position in the transport paths. The sheet guide 1, 1' is provided at a curved portion because abrasion is likely to occur at the curved portion, but the sheet guide 1, 1' may be provided at a flat location. Although the outer side of the curved portion is likely to come into contact with slacking recording paper, the sheet guide 1, 1' is also applicable to an inner side of the curved portion that is likely to come into contact with stretched recording paper. Thus, the sheet guide 1, 1' may be disposed opposite to the image surface on the first side instead of being disposed to face the image surface.

(H03) In the exemplary embodiments, the solenoid 2 and the motor 12 are exemplified as the actuator, but the actuator may be a combination of a link mechanism, a gear train, and a clutch. The sheet guide 1, 1' may be moved not only in two stages that are the separation position and the contact position but also in three or more stages including an intermediate position.

(H04) In the exemplary embodiments, the passage of the leading edge is determined by using the sheet sensor SN1 on the downstream side of the second gate GT2. The determination may be made based on a period from passage of the leading edge by a sheet sensor on an upstream side of the first gate GT1 or based on an elapsed period from any timing such as a paper feed timing or a timing when the recording paper is sent out by the registration rollers Rr.

(H05) In the exemplary embodiments, the sheet guide is not moved to the separation position in the case of plain paper, but may be moved to the separation position in the case of plain paper as well.

(H06) In the exemplary embodiments, the sheet guide 1 has the projecting threads 1*b*, but the projecting threads 1*b* may be omitted. The sheet guide 1 may have a plurality of hemispherical projections or a plurality of holes to reduce the transport resistance.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium transport device comprising:

a guide configured to guide a medium on which an image is recorded, and curved along a transport direction of the medium; and an actuator configured to actuate the guide between a contact position where the guide is in contact with the medium and a separation position where the guide is separated from the medium, wherein the guide is configured to move to the contact position until a leading edge of the medium in the transport direction passes along the guide, and move to the separation position after the leading edge of the medium in the transport direction has passed along the guide, wherein the guide is disposed in a reversing path along which a medium having an image formed on a first side is transported to reverse sides of the medium and form another image on a second side, and wherein the guide is configured to face the first side.

2. The medium transport device according to claim 1, wherein the guide is disposed on an outer side of a curved portion of a medium transport path.

3. The medium transport device according to claim 2, wherein the guide is configured to move along a thickness direction of the transported medium.

4. The medium transport device according to claim 1, wherein the guide is configured to move along a thickness direction of the transported medium.

5. The medium transport device according to claim 1, wherein the guide is configured to move between the contact position and the separation position about a rotation shaft disposed at one end of the guide in the transport direction.

6. The medium transport device according to claim 1, further comprising:

a medium detector disposed on a downstream side of the guide in the transport direction, and configured to detect the medium, wherein the guide is configured to move to the separation position in response to detection of the medium by the medium detector after the leading edge of the medium in the transport direction has passed along the guide.

7. The medium transport device according to claim 1, wherein the guide is configured not to move to the separation position if a type of the medium is a predetermined paper type.

8. The medium transport device according to claim 7, wherein the predetermined paper type is plain paper.

9. The medium transport device according to claim 1, wherein the guide comprises a plurality of projecting threads extending along the transport direction to come into contact with the medium, and disposed with distances between the projecting threads in a width direction of the medium.

10. An image forming apparatus comprising:

an image former configured to form an image on a medium; and the medium transport device according to claim 1 configured to transport the medium having the image formed by the image former.

11. The medium transport device according to claim 1, further comprising a pressure detector disposed on the guide, and configured to detect a pressure received from the medium, wherein the guide is configured to move to the separation position if the pressure detected by the pressure detector has reached a predetermined pressure after the leading edge of the medium in the transport direction has passed along the guide.

12. A medium transport device comprising:

a guide configured to guide a medium on which an image is recorded, and curved along a transport direction of the medium;

an actuator configured to actuate the guide between a contact position where the guide is in contact with the medium and a separation position where the guide is separated from the medium; and a pressure detector disposed on the guide, and configured to detect a pressure received from the medium, wherein the guide is configured to move to the contact position until a leading edge of the medium in the transport direction passes along the guide, and move to the separation position after the leading edge of the medium in the transport direction has passed along the guide, and wherein the guide is configured to move to the separation position if the pressure detected by the pressure detector has reached a predetermined pressure after the leading edge of the medium in the transport direction has passed along the guide.

13. A medium transport device comprising:

a guide configured to guide a medium on which an image is recorded, and curved along a transport direction of the medium;

an actuator configured to actuate the guide between a contact position where the guide is in contact with the medium and a separation position where the guide is separated from the medium; and a controller configured to control the actuator to move the guide to the contact position until a leading edge of the medium in the transport direction passes along the guide, and move the guide to the separation position after the leading edge of the medium in the transport direction has passed along the guide, wherein the guide is disposed in a reversing path along which a medium having an image formed on a first side is transported to reverse sides of the medium and form another image on a second side, and wherein the guide is configured to face the first side.

14. The medium transport device according to claim 13, wherein the guide is disposed on an outer side of a curved portion of a medium transport path.

15. The medium transport device according to claim 14, wherein the guide is configured to move along a thickness direction of the transported medium.

16. The medium transport device according to claim 13, wherein the guide is configured to move along a thickness direction of the transported medium.

17. The medium transport device according to claim 13, further comprising a pressure detector disposed on the guide, and configured to detect a pressure received from the medium, wherein the guide is configured to move to the separation position if the pressure detected by the pressure detector has reached a predetermined pressure after the leading edge of the medium in the transport direction has passed along the guide.

* * * * *